US007667619B2

(12) United States Patent
Montgomery, Sr.

(10) Patent No.: US 7,667,619 B2
(45) **Date of Patent: *Feb. 23, 2010**

(54) PARKING VIOLATION SURVEILLANCE SYSTEM

(76) Inventor: Phil Montgomery, Sr., 17420 Mt. Herrmann, #C, Fountain Valley, CA (US) 92708

( * ) Notice: Subject to any disclaimer, the term of this patent is extended or adjusted under 35 U.S.C. 154(b) by 452 days.

This patent is subject to a terminal disclaimer.

(21) Appl. No.: 11/497,981

(22) Filed: Aug. 2, 2006

(65) Prior Publication Data

US 2008/0030373 A1 Feb. 7, 2008

(51) Int. Cl.
*G08G 1/017* (2006.01)

(52) U.S. Cl. ..... 340/937; 340/932; 701/13

(58) Field of Classification Search ..... 340/932, 340/932.2, 937; 701/13
See application file for complete search history.

(56) References Cited

U.S. PATENT DOCUMENTS 3,757,916 A * 9/1973 Selby ..... 194/227
4,717,815 A * 1/1988 Tomer ..... 235/378
4,825,927 A * 5/1989 Woodrow ..... 160/1
5,339,000 A * 8/1994 Bashan et al. ..... 340/932.2
5,777,951 A * 7/1998 Mitschele et al. ..... 368/90
6,481,622 B2 * 11/2002 Hjelmvik ..... 235/384
6,885,311 B2 * 4/2005 Howard et al. ..... 340/932.2
7,104,447 B1 * 9/2006 Lopez et al. ..... 235/384
2004/0039632 A1 * 2/2004 Han et al. ..... 705/13
2005/0068196 A1 * 3/2005 Marin ..... 340/932.2
2006/0250277 A1 * 11/2006 Colak ..... 340/932.2

* cited by examiner

*Primary Examiner*—Daniel Wu
*Assistant Examiner*—Edny Labbees
(74) *Attorney, Agent, or Firm*—David G. Duckworth; Russo & Duckworth, LLP

(57) ABSTRACT

A parking control surveillance system is provided for monitoring vehicles within parking spaces for providing parking enforcement personnel information concerning authorized and unauthorized vehicles within the parking space. The parking control surveillance system includes a parking stop forming a curb or having dimensions substantially the same as traditional cement parking stops located at the rear of a parking space. The parking stop includes a video recorder for recording the identity or for obtaining images of vehicles entering or exiting the designated parking space. The parking stop further includes a transmitter for transmitting images and information such as the time of parking transgression to vehicle enforcement personnel. Preferably, the vehicle identity and time of parking are transmitted to a central office for billing the vehicle owner.

14 Claims, 4 Drawing Sheets

PARKING VIOLATION SURVEILLANCE SYSTEM

BACKGROUND OF THE INVENTION

The present invention relates to a parking violation recording system. More particularly, the present invention relates to a system for quickly recording violations which occur when a person parks illegally, such as parking within a handicapped parking spot without authorization or parking beyond an authorized time period.

Parking spaces are frequently in short supply and high in demand. Accordingly, cities and towns will often provide metered parking spaces and handicapped parking spaces. Handicapped spaces are designated only for authorized handicapped persons. The parking meters accept coins or dollar bills in return for time on the meter, which represents the amount of authorized time that the vehicle may remain within the parking space. If the vehicle remains within the parking space after the meter expires, the owner of the parked vehicle is subject to citation or towing.

The standard practice of issuing parking violations involves the use of officials, commonly referred to as "meter-maids". These officials scour the streets in search of violators. Once a violation is located, the official exits their vehicle, if not traveling on foot, and records important vehicle information. The officer then writes out a written acknowledgment of the violation, referred to as a parking citation or ticket.

Unfortunately, this process requires considerable time to search for and record violations. This time is costly and could be more productively used. In addition, parking violation officials frequently find numerous vehicles which are simultaneously violating parking laws. While the official is preparing one written citation, owners of other vehicles exit the scene before a violation can be issued. This also results in loss of money to the city.

Private parking spaces are also available in areas where parking is in short supply. These parking spaces typically come at some expense to the vehicle owner, but usually offer the convenience of not requiring that the owner pay money throughout the day. Moreover, private parking spaces often offer greater security and a convenient location. Many private garages issue a fixed number of monthly parking passes sometimes costing $200.00-$300.00 or more. Unfortunately, unauthorized persons often park in the assigned spaces resulting in significant inconvenience to both the owner of the private parking lot and the owner of the vehicle which is entitled to the parking space. In order to reduce the unauthorized parking within the assigned spaces, the parking lot owners will often employ expensive attendants to monitor the parking lot.

Various attempts have been made to overcome the problems associated with monitoring and recording the violations within a parking lot. U.S. Pat. No. 6,459,386 describes a parking violation monitoring system wherein a police vehicle drives down the street to record violations. The police vehicle includes cameras mounted on both sides of the vehicle which view parking meters and vehicle license plates to determine whether a violation has occurred. If the parking meter registers a lack of payment, the person's license plate is recorded and a ticket is mailed to the vehicle's owner. Meanwhile, U.S. Pat. No. 6,559,776 describes a parking control system which detects the presence of vehicles within a parking spot. This system further includes processors to determine whether the vehicle is authorized, and if a violation has occurred, the occurrence is communicated to a central processing office which takes corrective action. U.S. Patent Application Serial No. 2003/0128136 illustrates a parking meter which includes audio/visual communications with the central station. The parking meter transmits information regarding whether money has been accepted.

Unfortunately, the various automated systems suffer from various drawbacks. For example, the constructions are expensive to manufacture, difficult to use and/or require additional housings placed in the vicinity of the parking spaces.

Thus, there is a significant need for an improved parking surveillance system for recording parking violations.

There is an additional need for a parking surveillance system which is inexpensive to manufacture, unobtrusive and simple to install in the vicinity of a monitored parking space.

SUMMARY OF THE INVENTION

The present invention addresses the aforementioned problems associated with parking space surveillance systems by providing a substantially self-contained surveillance system located within the traditional parking stop typically found at the end of a parking space.

In a preferred embodiment, the parking stop is an elongate raised structure usually made of concrete which is positioned at the end of a parking spot for engaging a vehicle's tires so as to impede further movement of the vehicle. The parking stop is typically 4"-8" high, approximately 4"-8" deep, and extends substantially the width of a parking space, typically 6'-8'. In an alternative preferred embodiment, the parking stop is constructed as a traditional sidewalk curb for preventing further movement of a vehicle within the parking space.

The parking stop of the present invention includes a housing constructed of any of various materials as can be selected by those skilled in the art. For example, the housing can be constructed of cement, cement reinforced by steel rods, plastic, ceramic materials, composites, or mixtures thereof The parking stop further includes a video recorder located within the housing for recording the image or identity of vehicles entering, exiting or parked within a parking space. The term video recorder is intended to be interpreted broadly to include any apparatus which can record the image or identity of a vehicle, such a bar code reader or laser readers, in the event that such apparatus become sufficiently sophisticated to perform such functions. Presently acceptable video recorders include video cameras using traditional analog tape. However, preferably the video recorder includes a CCD type camera for recording images in digital format onto various memory devices as can be selected by those skilled in the art. For example, the memory device may be RAM, ROM, a simple hard drive, CD-ROM or a removable disk.

The parking surveillance system of the present invention further includes a vehicle presence detector for detecting whether a vehicle is present within a parking space. The vehicle presence detector may be a pressure sensor located underneath the parking space which is triggered by the weight of a vehicle entering the parking space. Alternatively, ultrasonic, laser or movement sensors may be utilized to determine the entry, exit or presence of a vehicle within the designated parking space.

The vehicle presence detector does not need to be located within the parking stop's housing, such would be the case where the vehicle presence detector is a pressure sensor located under the parking space. However, in a preferred embodiment, the vehicle presence detector is a motion sensor located within the parking stop which is positioned so as to detect the entry, exit or presence of vehicles within the parking space. Information concerning the presence of vehicles within the space, such as the time of occurrence and duration, is preferably stored within memory.

The parking surveillance system of the present invention may include a clock or similar time keeping mechanism for recording the time periods for which vehicles are parked within a parking space. The presence of vehicles may then be "time stamped" and recorded for later retrieval.

To this end, the parking surveillance system of the present invention further includes a transmitter for transmitting video images and data concerning time of parking to parking enforcement personnel. The transmission may be a removable disc or a simple output connector located upon the exterior of the parking stop for allowing persons to download information to a mobile computer for later processing. Alternatively, the transmitter may be a wireless transmitter for transmitting information to parking enforcement personnel. The wireless transmission may be by a short range transmission protocol such as Wi-Fi or Bluetooth. Alternatively, traditional cellular telephone systems may be utilized for transmitting information over the Public Switched Telephone Network (PSTN) to a parking enforcement headquarters.

In operation, the parking surveillance system records the presence and transmits information concerning the unauthorized parking of vehicles. The vehicle presence detector of the parking surveillance system determines when a vehicle has entered and exits a parking space. Again, this can be accomplished using ultrasonic, laser, pressure, or motion sensors or other known apparatus for detecting presence of a vehicle. This information is transmitted to a processor for determining the time and duration of vehicle presence. All vehicles may be photographed by the video recorder of the present invention, for example when entering or exiting the parking space. Alternatively, the parking surveillance system may record video images of the vehicle only if it has been determined that the vehicle has parked longer than a predetermined allotment of time, or after it has been determined that the vehicle has committed some other infraction.

Where the parking surveillance system is being used to monitor a handicapped parking space, preferably, the system records images of all vehicles which have parked within the parking space. Images are transmitted to parking surveillance personnel where it is determined whether the vehicle has proper authorization to park. The determination of whether the vehicle is authorized can be done in various ways such as by reviewing license plate records to determine whether the recorded license plate of the vehicle has been identified for use by a handicapped person. Alternatively, the recorded image can be analyzed, such as by using image processing software, to determine whether a handicap placard is being properly displayed.

Though the parking surveillance system of the present invention may be utilized in conjunction with a traditional parking meter wherein a person pays for parking at the meter, in a preferred embodiment the parking surveillance system is utilized for purposes of automatic billing of the vehicle owner. To this end, the parking surveillance system monitors the entry and exit of a vehicle within a parking spot to determine the duration of vehicle stay. The video recorder records the identity of the vehicle, such as by recording the vehicle's license plate, or in the event that automobiles are ultimately provided with bar codes of the like, by identifying the vehicle utilizing a bar code or laser reader. The parking duration and vehicle identity are transmitted to a central billing office. At the central billing office, the vehicle identity is cross checked with vehicle records, such as supplied by the Department of Motor Vehicles (DMV) to determine the vehicle's owner. The owner is then billed for his parking duration using various billing methods known to those skilled in the art. For example, the owner may be billed by mail after each parking occurrence. However, preferably the owner is billed periodically, such as once a year for all parking occurrences that have occurred during the previous period. In a preferred embodiment, the owner is billed by debiting a credit card which has previously been provided by the owner, or the owner is billed annually with his vehicle registration fee.

It is thus an object of the present invention to provide an inconspicuous and inexpensive parking surveillance system for monitoring parking spaces for the presence of unauthorized vehicles.

In still an additional object of the present invention to provide a surveillance system which reduces the amount of persons required for monitoring parking spaces.

It is still an additional object of the present invention to provide a substantially self-contained surveillance system which can utilize existing structures typically found within a parking lot.

These and other more specific objects and advantages of the invention will be apparent to those skilled in the art from the following detailed description taken in conjunction with the drawings.

DETAILED DESCRIPTION OF THE INVENTION

Figure 1:
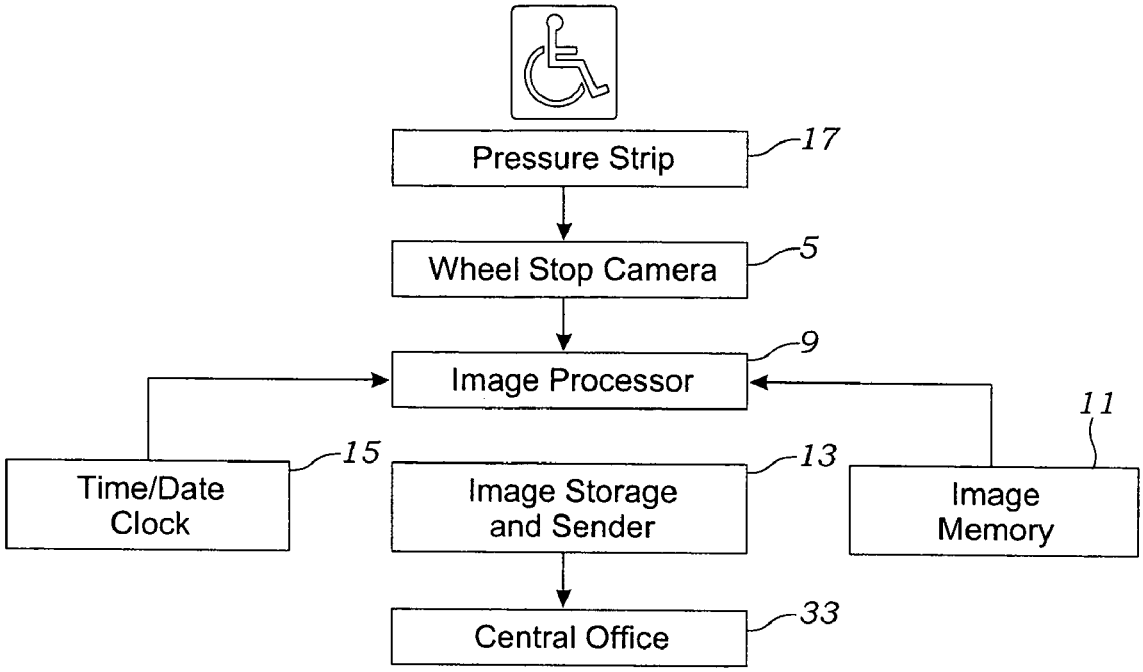
FIG. 1 is a flowchart illustrating operation of the parking status surveillance system of the present invention.

While the present invention is susceptible of embodiments in various forms, as shown in the drawings, hereinafter be described the presently preferred embodiments of the invention with the understanding that the present disclosure is to be considered as an exemplification of the invention and it is not intended to limit the invention to the specific embodiments illustrated.

Figure 6:
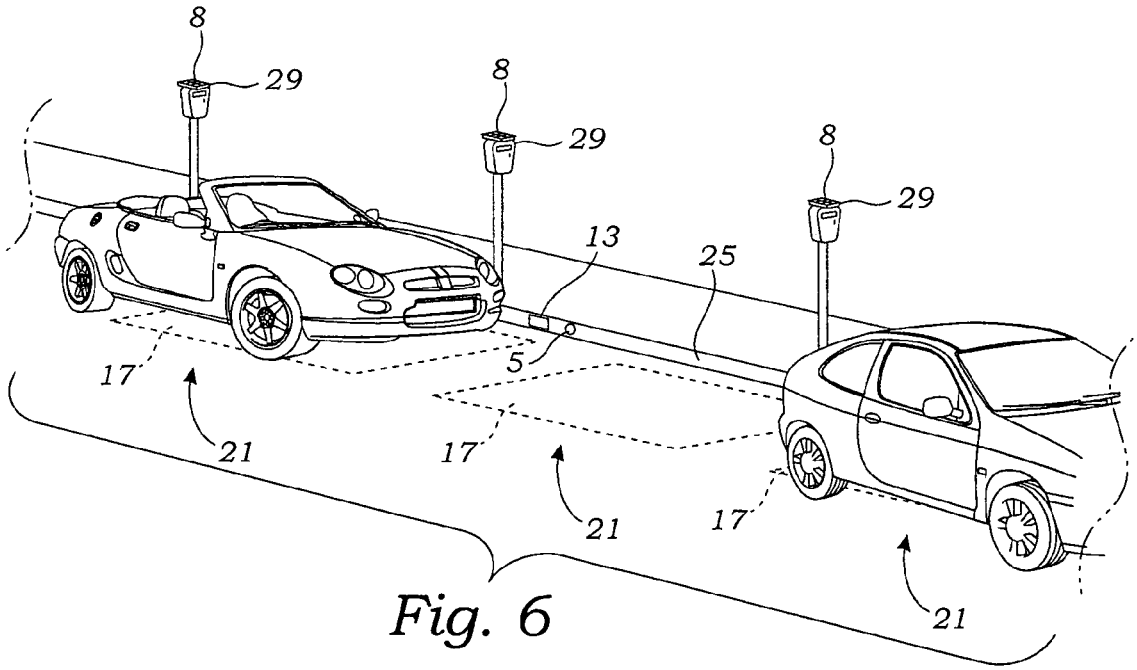
FIG. 6 is a perspective view illustrating an alternative preferred embodiment of the parking status surveillance system of the present invention.

As shown in the figures, the parking status control system 1 of the present invention includes a parking stop 3. Preferably, the parking stop is elongate and has dimensions substantially similar to parking stops ubiquitously found in parking lots around the world. More specifically, preferably the parking stop has dimensions of 4"-8" high, approximately 4"-8" deep, and extends substantially the width of the parking space. Alternatively, as shown in FIG. 6, the parking stop may be a curb which extends the length of the back or "stop" side 25 of numerous parking spaces.

The parking stop 3 of the present invention includes a housing 4 for storing various electronic components. Located within the housing, the parking stop includes a video recorder 5 for recording images, a power supply 7, a processor 9, memory 11 and a transmitter 13. The video recorder may be any construction for recording images of the vehicle, which preferably provides sufficiently high quality so as to obtain and record images of a vehicle's license plate. Where the parking space is designated for handicapped persons, preferably the camera provides sufficient quality of images and is positioned so as to record images of the vehicle's license plate and front windshield to determine whether a handicap placard is hanging from the vehicle's rearview mirror. To this end, the video recorder may be a traditional camera using film, an analog video recorder, or digital camera using a charge coupled device (CCD) imaging receptor. Alternatively, the video recorder may be a bar code reader, laser reader or similar device for recording the vehicle's license plate or identity of the vehicle.

Figure 3:
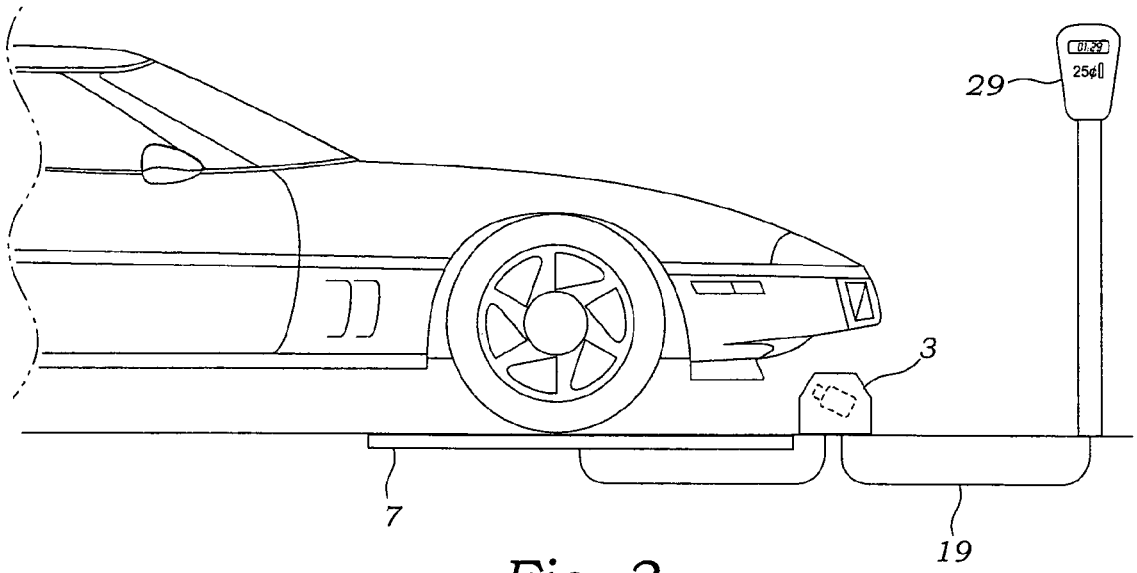
FIG. 3 is a side cutaway view illustrating a preferred embodiment of the parking status surveillance system of the present invention.
Figure 5:
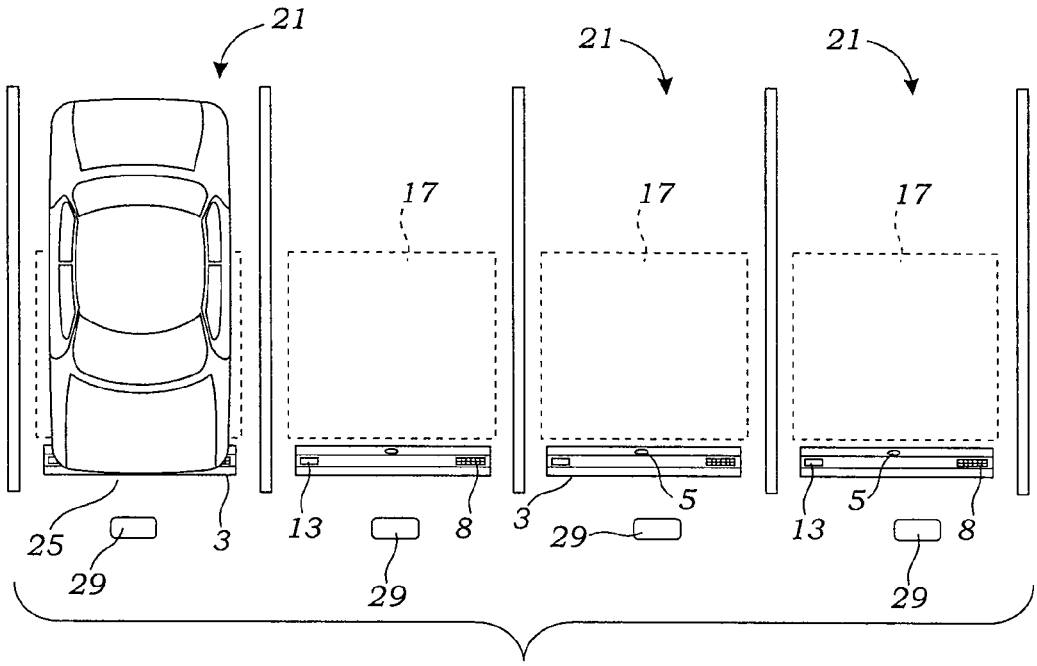
FIG. 5 is a top plan view illustrating a plurality of parking violation recording stops for use in detecting the presence of unauthorized persons within a parking space.

The parking status control system further includes a vehicle presence detector 29. The vehicle presence detector may be an ultrasonic, laser or motion sensor for detecting the entry, exit or presence of a vehicle within the parking space 21. Alternatively, the vehicle presence detector may utilize the electronics of the camera to determine changes of imagery, thereby suggesting motion within the camera's field of view. The vehicle presence detector may be located within the parking stop 3, such as where a vehicle presence detector is a laser, ultrasonic or motion sensor or utilizes the video recorder electronics. Alternatively, the vehicle presence detector may be located exterior to the parking stop 3. For example, as shown in FIGS. 3 and 5, the vehicle presence detector 29 may be a pressure sensor located under the concrete or asphalt of the parking space 21 which sends a signal upon being triggered by the weight of a vehicle entering or exiting the parking space.

The processor 9 is also preferably located within the parking stop 3. The processor 9 is connected to both the vehicle presence detector 17 and video recorder 5 so that based on predetermined criteria, the triggering of the vehicle presence detector is transmitted to the processor 9 which determines when the camera is to initiate recording of the designated parking space 21.

The parking status control system of the present invention further includes a power supply for supplying electrical power to the processor 9, vehicle presence detector 29, and video recorder 5. The power supply may be of numerous constructions known to those skilled in the art such as 120V cabling to a nearby power grid. However, preferably the power supply consists of one or more solar panels 8 and rechargeable batteries 7.

Figure 4:
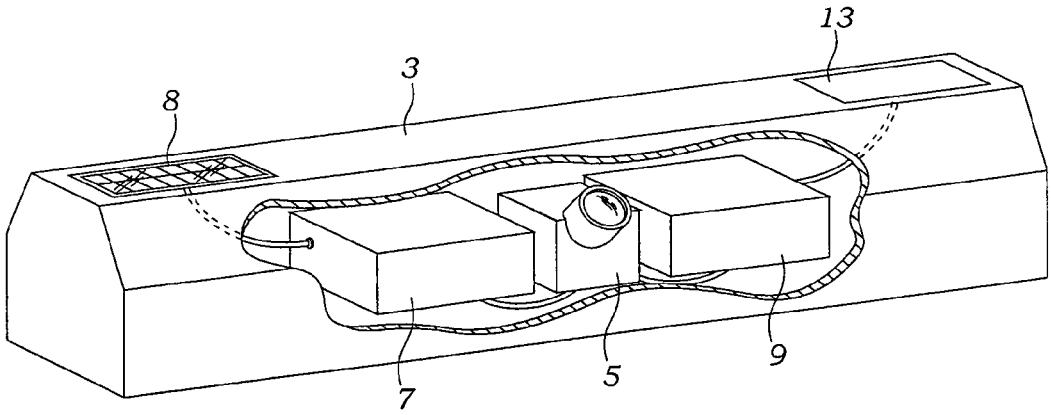
FIG. 4 is a cutaway view illustrating a parking violation recording stop of the present invention.

Finally, the parking status control system 1 of the present invention includes a transmitter for transmitting video images of an unauthorized vehicle and information concerning the time of parking of an unauthorized vehicle to parking enforcement personnel. The transmission equipment 13 may be cabling for transmitting information to parking enforcement personnel. Alternatively, the parking stop may include electrical connectors for allowing a person to connect a computer, such as a mobile laptop computer, for downloading information concerning the vehicles that have parked in the designated parking space. Alternatively, as shown in FIG. 4, the transmitter may comprise a wireless transmitter, such as a patch antenna, for transmitting the designated information by RF transmission. The wireless transmitter may transmit using a short range protocol such as Wi-Fi or Bluetooth or other short range transmission protocols. Alternatively, the transmitter 13 may comprise a cellular telephone transmitter for allowing the information to be transmitted directly to a local cellular network or a satellite network to thereafter be communicated over the Public Switched Telephone Network (PSTN) for ultimate receipt by the parking enforcement personnel.

With reference to FIG. 3, the parking status control system 1, including parking stop 3 and presence detector 17, may be connected to a parking meter 29. The parking meter 29 receives coins or dollar bills and preferably includes a digital display indicating the amount of time in which a person is authorized to park within the parking space. Preferably, the processor 9 is connected to the parking meter 29 so that when a vehicle is parked within the parking space beyond its authorized time, this determination can be made by the processor in cooperation with the vehicle presence detector which will determine whether the vehicle continues to be present within the parking space beyond the allotted time. If an unauthorized vehicle is present, the occurrence and period of infraction is preferably stored within memory for transmission to parking enforcement personnel. Moreover, preferably the processor includes a central clock so that the occurrence can be time and date stamped for further validating the unauthorized parking. In addition to the occurrence, time and period of infraction, preferably the memory retains a picture of the unauthorized vehicle which is preferably obtained as the vehicle enters or exits the parking space so as to provide the best view of the vehicle's license plate and windshield.

With reference to FIG. 1, in a preferred embodiment the vehicle presence detector 17, which may be a pressure strip located under the parking space, triggers the video recorder 5 to obtain an image of the vehicle when it enters the parking space. The image is then processed by the processor 9 and date and time stamped. The image and time and date stamp are recorded in memory. Any and all parking occurrences may be transmitted to a central office 33. Alternatively, the processor may selectively determine whether an unauthorized parking has occurred and designate only infractions for transmission by the transmitter 13 to the central office.

Figure 7:
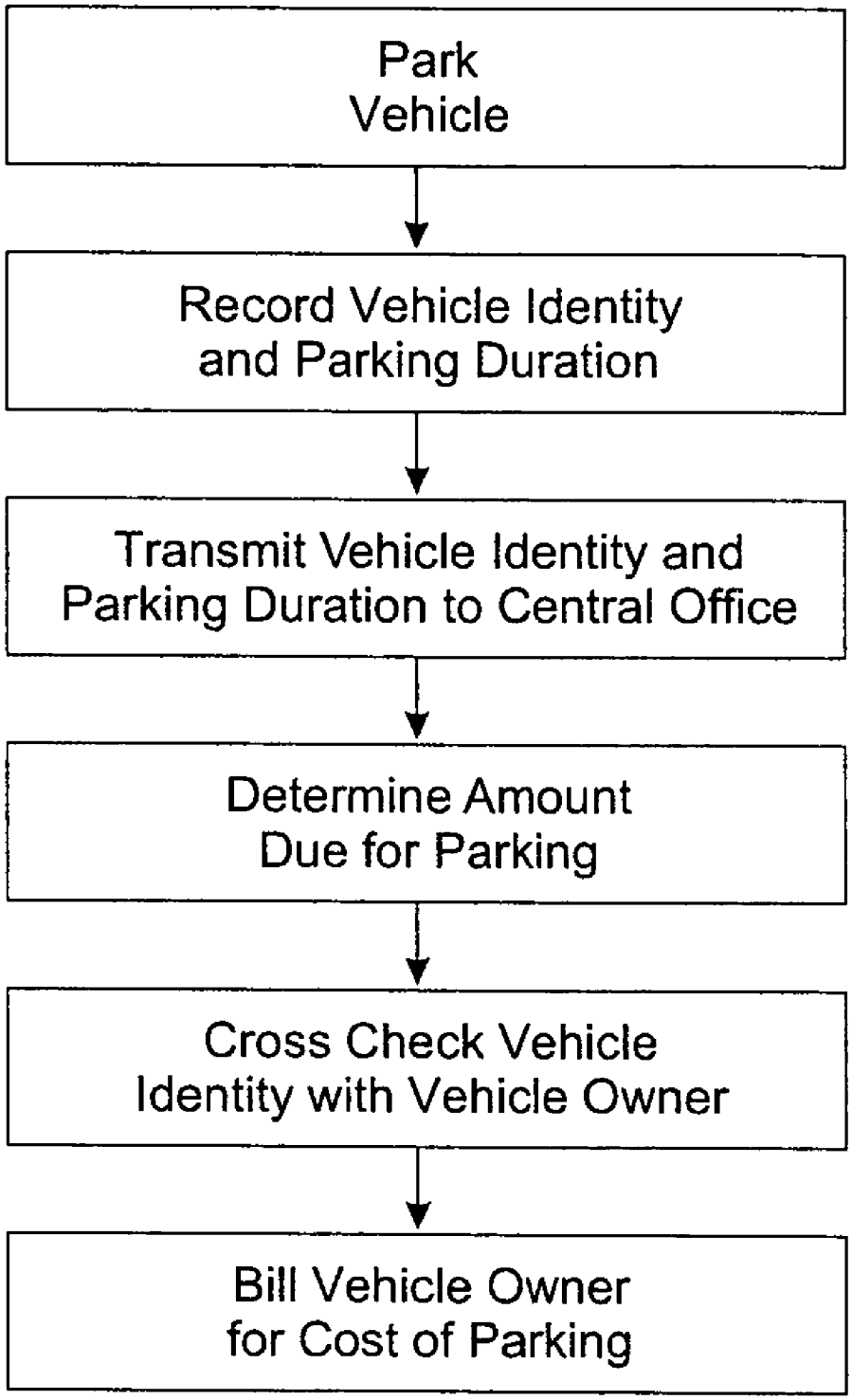
FIG. 7 is a flow chart illustrating a preferred method of billing vehicle owners using the parking surveillance system of the present invention.

With reference to FIG. 7, advantageously the parking surveillance system may be utilized for automatic billing of a vehicle owner. More specifically, instead of paying a parking meter, such as shown in FIG. 3, or paying for parking at a nearby kiosk, the parking surveillance system of the present invention permits vehicle owners to be billed at a later date. In operation, a vehicle owner parks his vehicle. With reference to FIGS. 1-6, the vehicle presence detector 17 triggers the video recorder to identify the vehicle when it enters the parking space. Furthermore, a vehicle presence detector causes the parking surveillance system to determine entry and exit times of the vehicle. Information relating to the parking incident, including vehicle identity, entry and exit times, parking duration, and/or associated parking costs are transmitted by wire or wireless transmitter to a central office. As would be understood by those skilled in the art, the amount owed for parking can be calculated either on-site by electronics stored within the parking stop 3 or may be calculated by the persons or electronics at a central office.

At the central office, the vehicle identity is cross-checked with vehicle records. As provided by government offices, preferably the vehicle records will provide an address, credit card number or information relating to the vehicle registration so as to enable the vehicle owner to be billed. Vehicle owners may be billed immediately after each parking incident. However, it is preferred that the vehicle owner be billed periodically, such as monthly or annually, since it could be overly burdensome to bill some persons who live in urban settings and park several times a day at monitored parking spaces.

Even more preferably, the parking incidences are billed annually in conjunction with the billing for a vehicle registration payment.

Various modifications of this method of billing the vehicle owner can be made. For example, it is preferred that the vehicle presence detector be a motion detector or pressure sensor mounted at the parking space. However, other constructions may be utilized such as lasers or the like. Moreover, it is preferred that the video recorder be positioned within the parking stop, as shown in FIGS. 3-6. However, the video recorder may be positioned in other places such as on adjacent walls or mounted in housings on the sidewalk. In addition, cross-checking the vehicle's identity with vehicle records can be done manually. However, it is preferred that the cross-checking be conducted automatically, such as utilizing pattern recognition software for analyzing video images of the vehicle's license plate to determine the license number. Once determined automatically by software, it is preferred that billing continue in a substantially automatic manner in which vehicle registration records or billing notices are updated and sent automatically.

Figure 2:
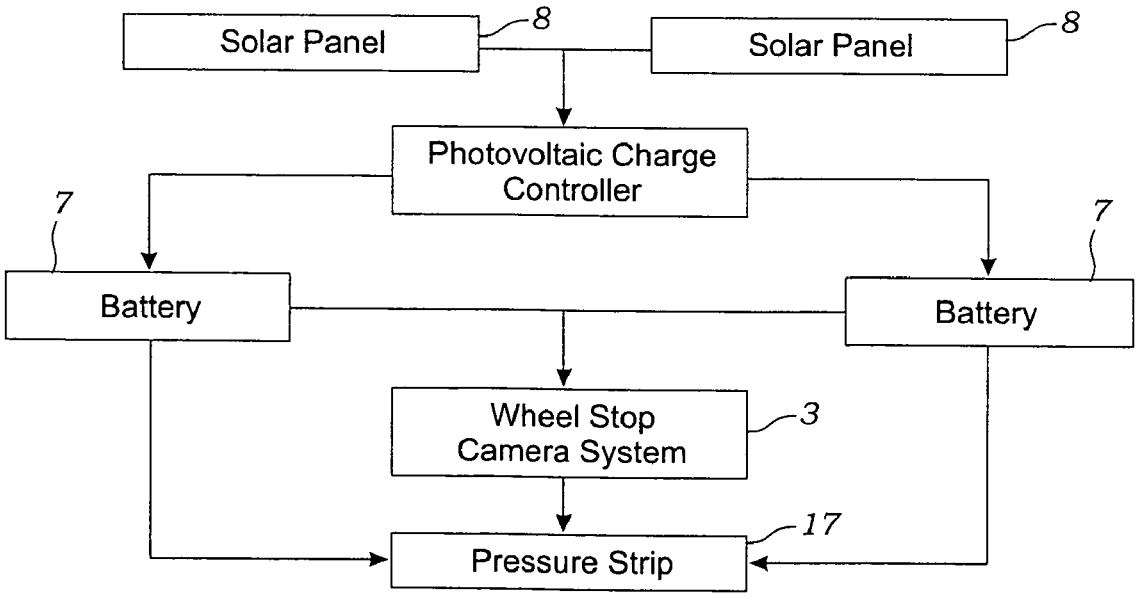
FIG. 2 is a flowchart illustrating operation of the individual components of the parking violation surveillance system of the present invention.

With reference to FIGS. 2 and 4, the parking status control system may include various components which may be constructed in various manners as can be determined by one skilled in the art. In a preferred construction, the parking stop 3 includes a pair of solar panels 8 which transmit electrical power through a charge controller to be stored within batteries 7. Alternatively, as shown in FIG. 6, solar panels are positioned atop the parking meters to provide electrical power to the batteries. The batteries are then used to provide power to the video recorder 5 and the vehicle presence detector 17, as well as the additional system components such as the processor and transmitter.

Although the present invention has been described with reference to the preferred embodiments, workers skilled in the art will recognize that changes may be made in form and detail without departing from the spirit and scope of the invention. Thus, the present invention is intended to be limited only to the following claims.

I claim:

1. A parking status control system comprising:

a parking space sized and constructed for parking a vehicle, the parking space including a stop side;

a vehicle presence detector for detecting the presence of a vehicle;

a parking stop for obstructing the movement of the vehicle, said parking stop located at said stop side of said parking space; and a video recorder located within said parking stop, said video recorder positioned for recording the identity of vehicles parking in said parking space.

2. The parking status control system of claim 1 further comprising:

a transmitter for transmitting the identity of vehicles to parking enforcement personnel.

3. The parking status control system of claim 1 further comprising:

a processor connected to said vehicle presence detector for processing predetermined variables to determine whether a vehicle parked within said parking space is parked without authorization; and a transmitter for transmitting the identity of vehicles to parking enforcement personnel, said transmitter transmitting said the identity upon determination by said processor that a vehicle parked within said parking space is parked without authorization.

4. The parking status control system of claim 3 wherein said processor and transmitter are located within said parking stop.

5. The parking status control system of claim 4 wherein said processor, transmitter and vehicle presence detector are located within said parking stop.

6. The parking status control system of claim 1 wherein said parking stop is an elongate structure extending parallel to said stop side, and said parking stop is sized to engage the tires of a vehicle to obstruct vehicle movement but not engage the bumper or undercarriage of a vehicle.

7. The parking status control system of claim 6 further comprising:

a transmitter for transmitting the identity of vehicles to parking enforcement personnel.

8. The parking status control system of claim 6 further comprising:

a processor connected to said vehicle presence detector for processing predetermined variables to determine whether a vehicle parked within said parking space is parked without authorization; and a transmitter for transmitting the identity of vehicles to parking enforcement personnel, said transmitter transmitting said identity upon determination by said processor that a vehicle parked within said parking space is parked without authorization.

9. The parking status control system of claim 8 wherein said processor and transmitter are located within said parking stop.

10. The parking status control system of claim 9 wherein said processor, transmitter and vehicle presence detector are located within said parking stop.

11. The parking status control system of claim 10 wherein said parking stop is an elongate structure extending parallel to said stop side, and said parking stop is sized to engage the tires of a vehicle to obstruct vehicle movement but not engage the bumper or undercarriage of a vehicle.

12. A self-contained parking status control system comprising:

a parking space sized and constructed for parking a vehicle, the parking space including a stop side;

a vehicle presence detector for detecting the presence of a vehicle;

a parking stop located at said stop side of said parking space, said parking stop sized to engage the tires of a vehicle to obstruct vehicle movement but not engage the bumper or undercarriage of a vehicle;

a video recorder located within said parking stop, said video recorder positioned for recording the identity of vehicles parking in said parking space;

a processor located within said parking stop connected to said vehicle presence detector for processing predetermined variables to determine whether a vehicle parked within said parking space is parked without authorization; and a transmitter located within said parking stop for transmitting the identity of vehicles to parking enforcement personnel.

13. A method of billing for parking comprising the steps of:

providing a parking space including a stop side with the parking space sized and constructed for parking a vehicle, a parking stop located at the stop side of the parking space, and a parking status control system including a vehicle presence detector for detecting the presence of a vehicle, a video recorder located within the parking stop for recording the identity of vehicles parked in the parking space, a transmitter for transmitting the vehicle identity to a central office, and vehicle records including billing information regarding vehicles' owners;

parking a vehicle within the parking space without violating a law or otherwise incurring a legal infraction;

calculating the duration of time the vehicle is parked within the parking space;

recording the vehicle's identity by the video recorder;

transmitting the vehicle's identity to the central office;

cross-checking the vehicle's identity with vehicle records to obtain billing information regarding the vehicle's owner;

calculating the amount owed for parking the vehicle in the parking space for billing the vehicle's owner based upon the duration of time the vehicle was parked within the parking space; and billing the owner for parking the vehicle within the parking space utilizing the billing records.

14. The method of billing for parking of claim 13 further comprising the step of:

determining the vehicle's time of entry and exit into the parking space by the vehicle presence detector.

* * * * *